US010428468B2

(12) United States Patent
Constantine et al.

(10) Patent No.: US 10,428,468 B2
(45) Date of Patent: Oct. 1, 2019

(54) TRACK-MOUNTING ASSEMBLY

(71) Applicant: Progress Rail A Caterpillar Company, Albertville, AL (US)

(72) Inventors: Edward Constantine, Kansas City, MO (US); Wilbur F. Osler, Mattituck, NY (US)

(73) Assignee: PROGRESS RAIL A CATERPILLAR COMPANY, Albertville, AL (US)

( * ) Notice: Subject to any disclaimer, the term of this patent is extended or adjusted under 35 U.S.C. 154(b) by 290 days.

(21) Appl. No.: 15/627,769

(22) Filed: Jun. 20, 2017

(65) Prior Publication Data

US 2018/0363250 A1 Dec. 20, 2018

(51) Int. Cl.
*E01B 9/62* (2006.01)
*E01B 9/42* (2006.01)
*E01B 9/48* (2006.01)

(52) U.S. Cl.
CPC ..... *E01B 9/62* (2013.01); *E01B 9/42* (2013.01); *E01B 9/483* (2013.01)

(58) Field of Classification Search
CPC ... E01B 9/42; E01B 9/483; E01B 9/60; E01B 9/62; E01B 9/64
See application file for complete search history.

(56) References Cited

U.S. PATENT DOCUMENTS 4,577,801 A * 3/1986 Ortwein ..... E01B 9/62 238/25
4,715,533 A * 12/1987 Bucksbee ..... E01B 9/62 238/264
9,004,372 B1 * 4/2015 Alsop ..... E01B 9/62 238/264
2005/0045059 A1 * 3/2005 Osler ..... E01B 9/68 105/199.4
2008/0265050 A1 * 10/2008 Osler ..... E01B 9/10 238/315
2009/0184172 A1 * 7/2009 Osler ..... E01B 9/62 238/283
2012/0091216 A1 * 4/2012 Osler ..... E01B 9/38 238/283
2016/0298298 A1 * 10/2016 Constantine ..... E01B 9/42
2018/0016754 A1 * 1/2018 Alsop ..... E01B 9/54
2018/0023257 A1 * 1/2018 Constantine ..... E01B 9/40 238/304
2018/0274177 A1 * 9/2018 Gnaczynski ..... E01B 9/303
2018/0282949 A1 * 10/2018 Click ..... E01B 9/60

* cited by examiner

*Primary Examiner* — Jason C Smith
(74) *Attorney, Agent, or Firm* — Andrew Wilford

(57) ABSTRACT

A track-mounting assembly secures a longitudinally extending rail direction to a substrate and has a frame fixed to the substrate and a track plate fitted in the frame. A vertically throughgoing aperture of the frame has an inner edge formed by a longitudinally extending gauge surface directed transversely toward a field side of the assembly and a transversely oppositely directed and longitudinally extending field surface. The track plate carries the rail and has an outer edge is itself formed by a longitudinally extending field surface spacedly transversely confronting the gauge surface of the aperture and a longitudinally extending gauge surface spacedly transversely confronting the field surface of the aperture. The field surface of the track plate is of substantially greater area than the gauge surface of the aperture. An elastomeric mass fills between the frame and the track plate.

7 Claims, 4 Drawing Sheets

TRACK-MOUNTING ASSEMBLY

FIELD OF THE INVENTION

The present invention relates to a track-mounting assembly.

BACKGROUND OF THE INVENTION

Whereas in the field on a relative straight run, it is standard to secure a track to sleepers with spikes or relatively simple hold-down assemblies, in a station or around a switch, where sleepers are not used and instead there is a poured concrete bed serving as substrate, it is preferred to use a somewhat more complex mounting assembly. Such an assembly holds the track down while permitting at least limited movement transverse of the longitudinal extension of the track, both vertically and horizontally. Such assemblies must be exceptionally rugged and have very long service lives, while still being mass producible at a reasonable unit cost since they are used in large numbers.

The existing assemblies such as described in commonly owned U.S. Pat. No. 8,056,826 and published application 2016/0298298 comprise a track plate having a top face forming a seat adapted to carry the track, a base plate or frame adapted to be anchored to the substrate, surrounding at least the lower region of the track plate, and an elastic jacket engaged between the track plate and frame and covering most of the outer surfaces of the track plate and frame. The frame is bolted down to the substrate carrying the assembly, and the rail resting in the rail seat is held down by spring clips.

Both the track plate and the frame are typically, seen from above, basically rectangular and symmetrical to a plane perpendicular to the longitudinal rail direction, and as mentioned above the frame forms a vertically throughgoing aperture in which the track plate fits when resting on the substrate either directly or via one or more thin sheets of metal and/or elastomer. Two holes are formed in diagonally opposite holes of the frame for fixing it to the substrate, and the clips fit in respective eyes that are offset to one another longitudinally of the track carried by the assembly.

Such assemblies are relatively heavy and expensive to manufacture. Since they are often mass produced and used in large quantities, it is imperative to minimize the mass of the parts and the difficulty and cost of manufacture.

OBJECTS OF THE INVENTION

It is therefore an object of the present invention to provide an improved track-mounting assembly.

Another object is the provision of such an improved track-mounting assembly that overcomes the above-given disadvantages, in particular that can be made significantly lighter and simpler than the known such assemblies, yet that in service is just as effective with at least as long a service life.

SUMMARY OF THE INVENTION

A track-mounting assembly for securing a rail extending in a longitudinal direction to a substrate has a frame fixable to the substrate and a track plate fitted in the frame. The frame is formed with a vertically throughgoing aperture having an inner face or edge formed by a longitudinally extending gauge surface directed transversely toward a field side of the assembly and a transversely oppositely directed and longitudinally extending field surface directed toward a gauge side of the assembly and of substantially greater area than the gauge surface. The track plate has an upwardly directed rail seat on which the rail is supported and an outer edge that is itself formed by a longitudinally extending field surface spacedly transversely confronting and of generally the same area as the field surface of the aperture and a longitudinally extending gauge surface spacedly transversely confronting and of generally the same area as the gauge surface of the aperture. The field surface of the track plate is of substantially greater area than the gauge surface of the aperture. An elastomeric mass generally fills a space between the gauge surfaces and the field surfaces of the aperture and track plate.

The term "gauge" relates to the side of a rail or rail-mounting assembly that is turned toward the other rail, and "field" refers to the opposite side turned away from the other rail.

The invention is based on the discovery that of the various forces that the track-mounting assembly is intended to resist, forces in at least one direction are significantly smaller than those in the opposite direction. More particularly, since a railroad-car wheel has a flange that is on the inside or gauge side of the track, the horizontal forces outward toward the field side of the track are much greater than the inward forces toward the gauge side. Thus it is not necessary to construct the assembly to buttress significant forces toward the gauge side. Eliminating the structure that is responsible for this unneeded inward buttressing allows the assembly to be made about 20% lighter, which represents a considerable saving on manufacturing and shipping costs for an item typically weighing in the neighborhood of 13 kg.

In accordance with the invention the field surface forming part of the inner edge of the aperture has a surface area much larger than the area of the gauge surface forming an oppositely directed other part of the inner edge of the aperture.

More particularly the field surface of the gauge surface of the aperture has two sections that are longitudinally and transversely offset from each other and the confronting field surface of the track plate also has two sections that are longitudinally and transversely offset from each other and that each confront a respective one of the sections of the field surface of the aperture.

According to another feature of the invention the elastomeric mass substantially completely fills the space between the inner edge of the aperture and the outer edge of the track plate. Furthermore, the elastomeric mass forms a jacket covering at least some outer surfaces of the track plate and frame.

In accordance with the invention the frame has two transversely extending and longitudinally spaced sides longitudinally delimiting the aperture. One of the sides has two straight end sections longitudinally offset from each other and each perpendicular to the longitudinal direction, and a center curved section extending generally between the straight end sections. The other of the sides has two straight end sections longitudinally offset from each other and each perpendicular to the longitudinal direction, and a center straight section forming part of the field surface of the gauge surface and extending parallel to the longitudinal direction. Thus the assembly of this invention is asymmetrical to a vertical plane perpendicular to the longitudinal direction and tapers from the field side to the gauge side of the assembly.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
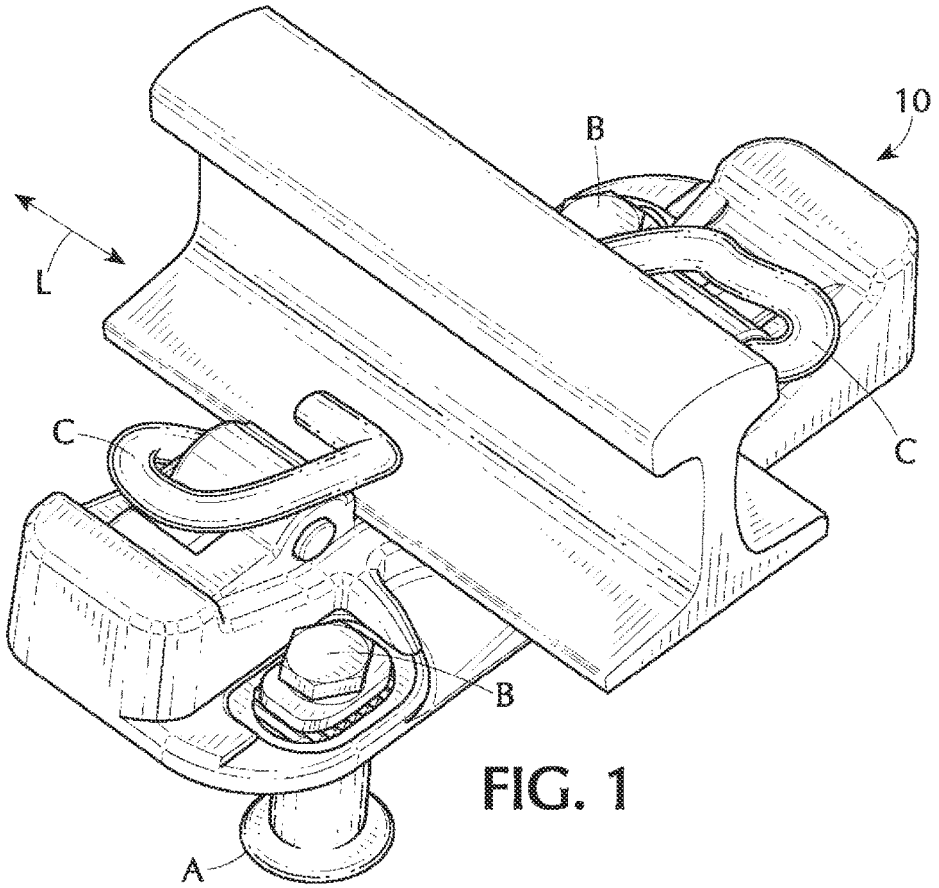
FIG. 1 is a perspective view from above of a track assembly along with a rail, anchor bolts, and hold-down clips that are not part of the invention.

As seen in FIG. 1 a rail assembly 10 according to the invention serves for supporting a rail R extending in a longitudinal and horizontal direction L and held down on the assembly 10 by a pair of standard E-clips C. The assembly 10 is in turn held down by a pair of bolts B set in anchors A themselves embedded in an unillustrated substrate, for instance a concrete slab. The rail R, clips C, bolts B, and anchors A are standard and well known in the art.

Figure 2:
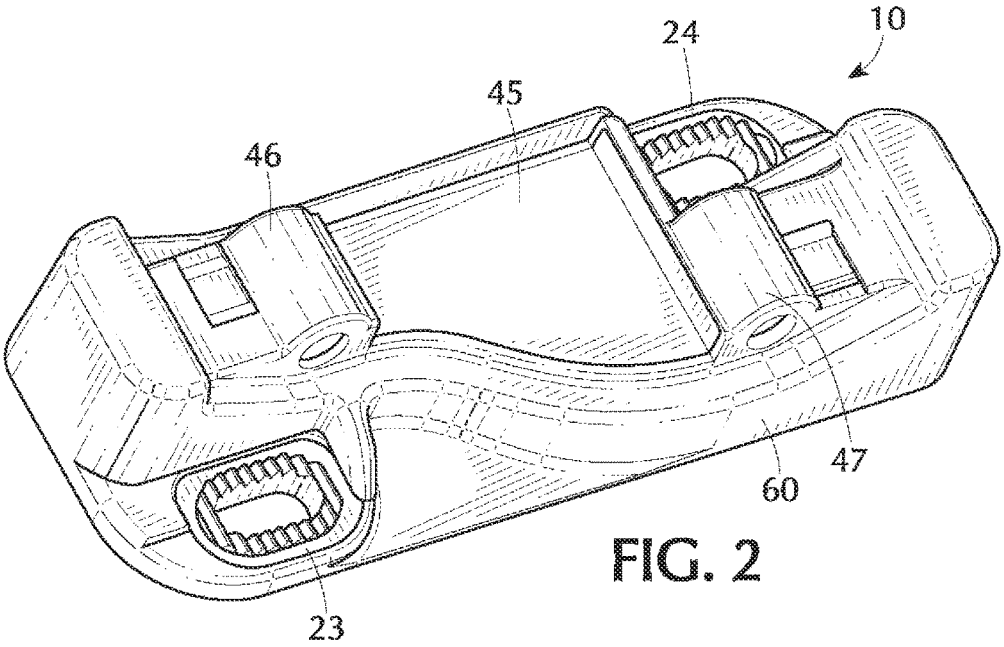
FIG. 2 is a view like FIG. 1, but showing only the mounting assembly.
Figure 3:
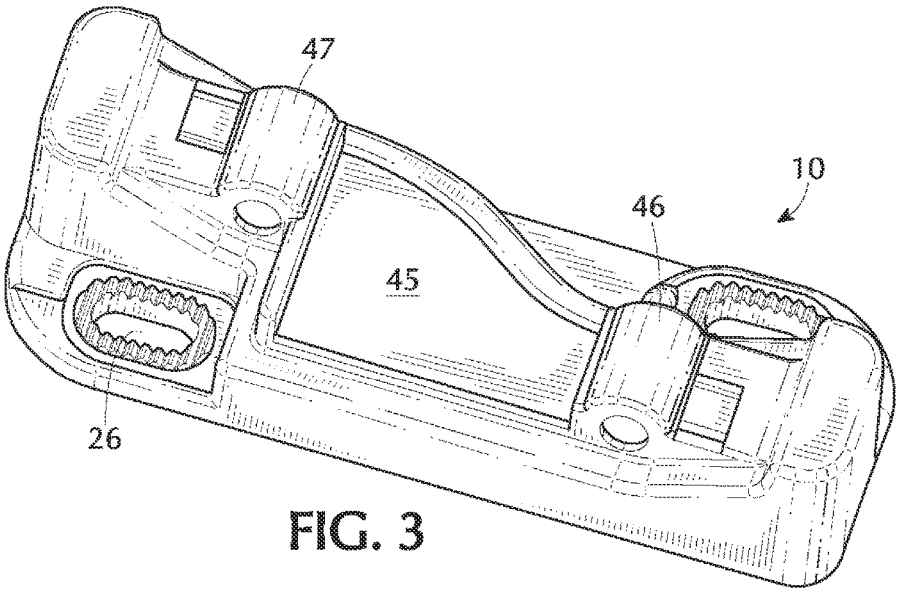
FIG. 3 is a perspective view like FIG. 2, but from the opposite side.
Figure 4:
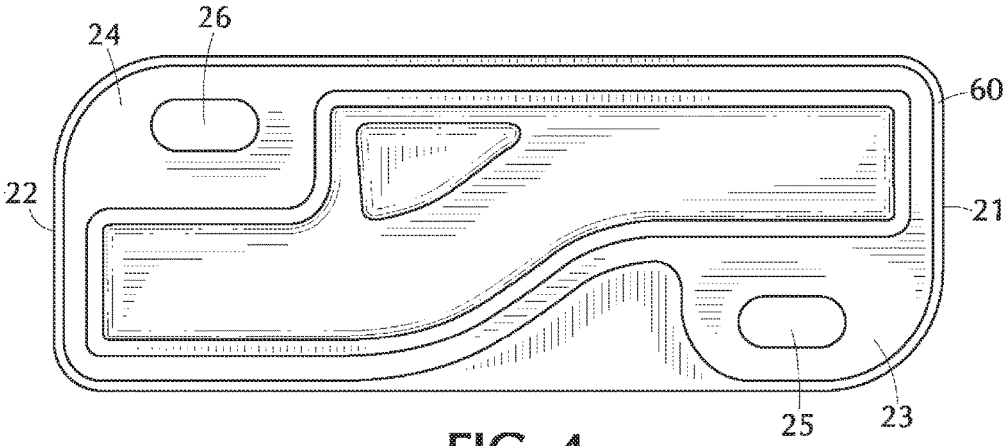
FIG. 4 is a bottom view of the rail assembly.

As shown in more detail in FIGS. 2-11, the assembly 10 basically comprises a frame 20 of ductile cast iron, a track plate 40 also of cast iron, and an elastomeric plastic jacket 60 that engages over and between the frame 20 and plate 40 and that is only shown in FIGS. 2 and 3. The jacket 60 is typically formed directly on the parts 20 and 40 and can bear indicia regarding origin, part number, and the like.

The frame 20 as shown in FIGS. 5-8 is elongated horizontally perpendicular to the direction L and has a gauge end 21 and a field end 22 formed with respective tabs 23 and 24 in turn formed with respective transversely extending throughgoing slots 25 and 26 surrounded by respective arrays 27 and 28 of ridges. The bolts B pass through these slots 25 and 26 and have heads that each bear downward through a respective lock washer and a respective ridged washer on the ridged areas 27 and 28 of the tabs 23 and 24 to lock the frame 20 to the respective anchor A in the unillustrated substrate. The holes 25 and 26 are spaced in and transverse to the direction L at a standardized spacing for a track-mounting assembly, so that the inventive system can be used to replace the bulkier prior-art assembly.

Here the tabs 23 and 24 with the slots 24 and 25 are respectively shown at the gauge and field ends 21 and 22 of the assembly. They could be oppositely located, that is set in opposite quadrants for instance for use with a different style of eClip.

In addition the frame 20 forms an elongated aperture 29 that is vertically throughgoing and that has an inner edge 30 complementary to an outer edge 41 of the track plate 40 as described below. This inner edge 30 has a two parallel field surfaces 31 and 35 transversely in line with the field slot 26, directed toward the gauge side 21, adjacent the field end 22, and extending at a transverse spacing parallel to the longitudinal direction L. The field surfaces 31 and 35 serve to buttress the track plate 40 against outward movement toward the end 22 as described below. At the gauge end 21 the inner edge 30 has a gauge surface 32 extending parallel to the direction L, directed toward the field end 22, and oppositely buttressing the track plate 40.

The inner frame edge 30 further has a side surface 33 extending straight and perpendicular to the direction L from the surface 31 to the surface 32, and another side surface 34 extending perpendicular to the direction L between the surfaces 31 and 35. A generally S-shaped side wall surface 36 with two straight end sections juxtaposed with the gauge and field ends 21 and 22 and a curved central section extends between the surfaces 35 and 32 and forms the rest of the surface 36, so that the aperture 29 is widest at the field end 22 measured longitudinally at the surface 31.

Figure 5:
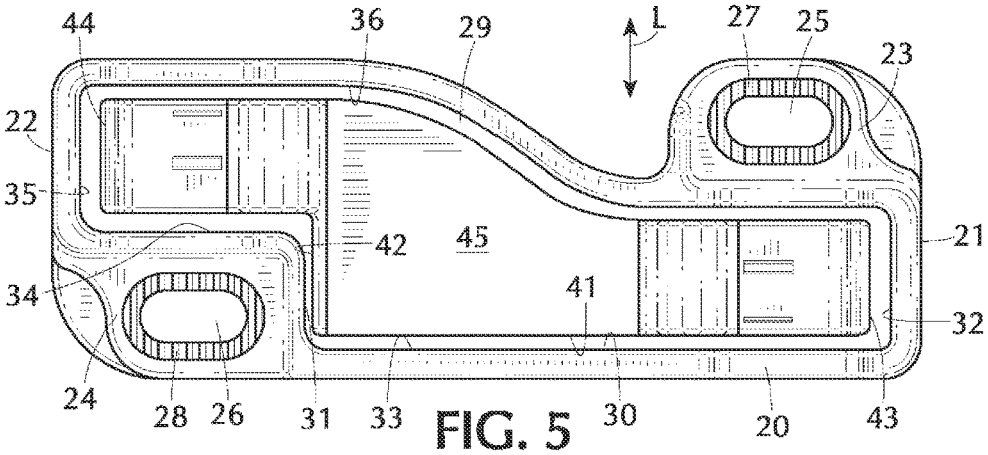
FIG. 5 is a top view of the rail assembly without the jacket, showing only the track plate and frame.
Figure 6:
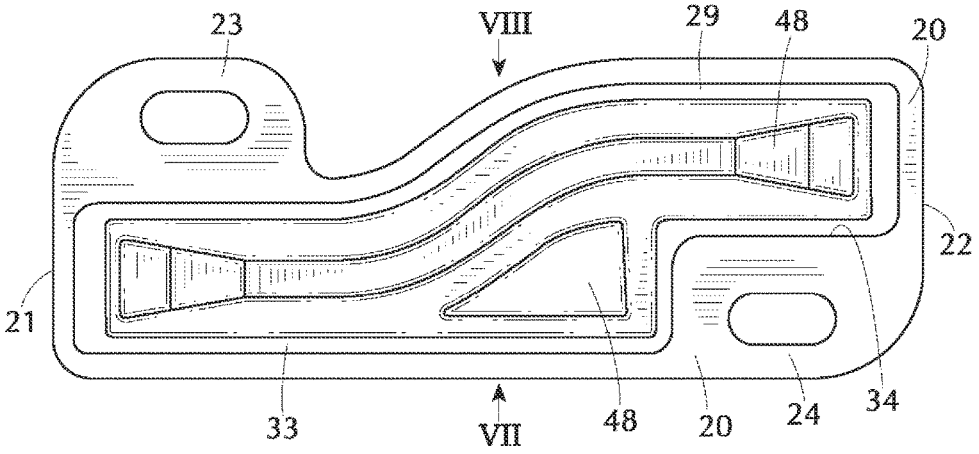
FIG. 6 is a bottom view of the structure of FIG. 5.
Figure 7:
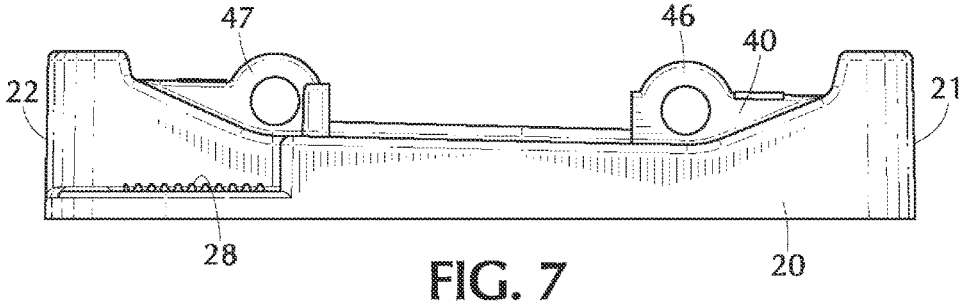
FIGS. 7 and 8 are side views taken in the direction of respective arrows VII and VIII of FIG. 6.
Figure 8:
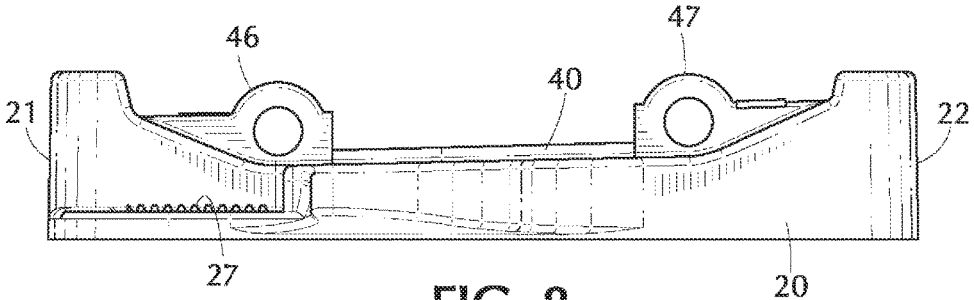

Thus, going clockwise as shown in FIG. 5 starting from the right-hand gauge end 21, the inner edge 30 is formed by:

the gauge surface 32,
the side surface 33,
the field surface 31,
the side surface 34,
the field surface 35, and
the other side surface 36.

The track plate 40 as shown in FIGS. 5-11 forms a flat rail seat 45 on which the rail R sits, and has gauge and field integral eyes 46 and 47 in which the E-clips C are engaged, as is standard. These eyes 46 and 47 are offset from each other in the direction L as is also standard. The seat 45 can be canted to the horizontal or parallel thereto.

The outer edge 41 of the plate 40 is as mentioned above exactly complementary to the inner edge 30 of the aperture 20. Thus it has a shoulder surface 42 that extends parallel to and directly confronts the surface 31. In addition the plate 40 has gauge and field end surfaces 43 and 44 that are parallel to and directly confront the surfaces 32 and 35 of the frame 20.

Thus when loaded transversely and horizontally perpendicular to the direction L toward the field side 22, the two surfaces 42 and 44 will compress the jacket 60 against the surfaces 31 and 35. Loading in the opposite direction toward the gauge side 21, which is much less likely to occur or be a problem, will compress the jacket 60 between the smaller surfaces 32 and 43. The surface area being employed to resist the typical loading toward the field side 22 is therefore about twice as great as is effective in the opposite direction, which is not a serious issue since such loading is not normally significant as the flanges of the train wheels are juxtaposed in the gauge region between the tracks.

Figure 9:
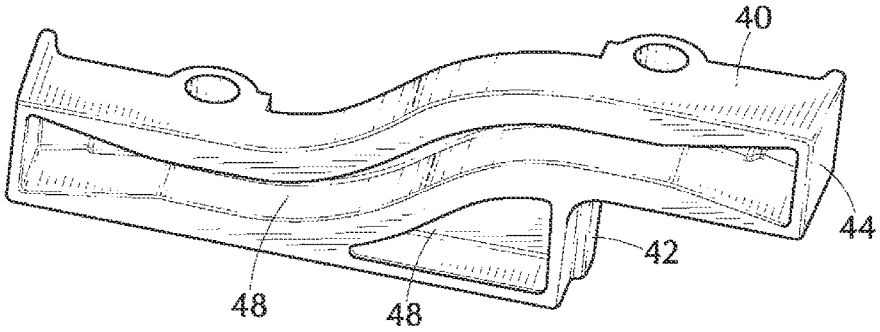
FIGS. 9 and 10 are perspective views respectively from below and from above of only the track plate.
Figure 10:
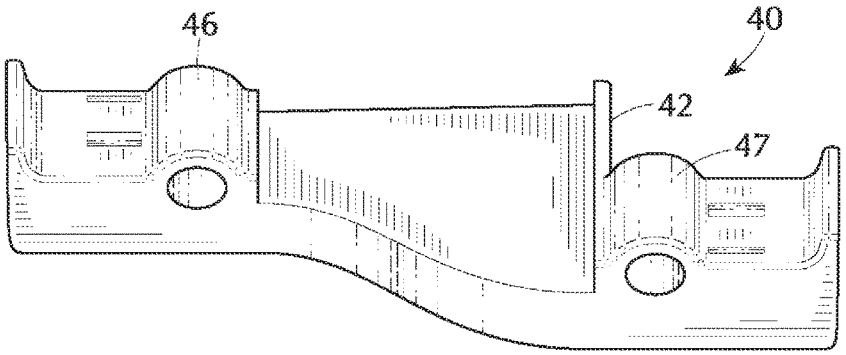
Figure 11:
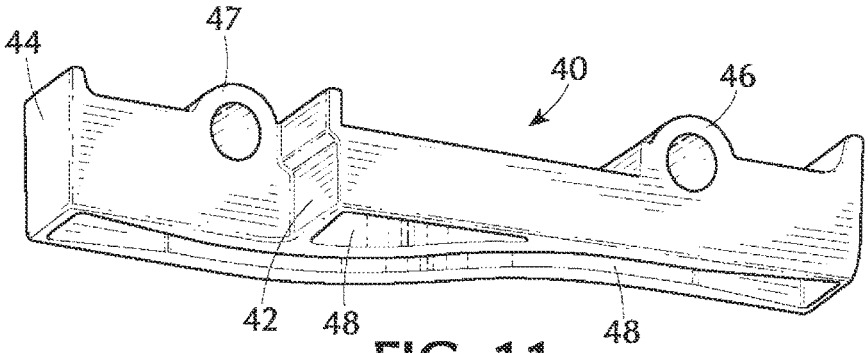
FIG. 11 is another perspective of the track plate from below but from the opposite side as FIG. 10.

Finally FIGS. 9-11 show how the underside of the track plate is formed with recesses 48 that are typically filled with the elastomeric mass forming the jacket 60, although as described in commonly owned application Ser. No. 14/682,219 filed 9 Apr. 2015 some spacing can be left here to vary the resistance to compression of the jacket. These recesses 48 in FIGS. 6 and 9 can vary considerably according to intended load.

With respect to the formation of the jacket 60 to control downward movement of the track plate 40, see copending application Ser. No. 14/682,219 filed 9 Apr. 2015, whose entire disclosure is herewith incorporated by reference.

We claim:

1. A track-mounting assembly for securing a rail extending in a longitudinal direction to a substrate, the assembly comprising:

a frame fixable to the substrate and formed with a vertically throughgoing aperture having an inner edge formed by a longitudinally extending gauge surface directed transversely toward a field side of the assembly and a transversely oppositely directed and longitudinally extending field surface directed toward a gauge side of the assembly and of substantially greater area than the gauge surface;

a track plate in the aperture and having an upwardly directed rail seat on which the rail is supported and an outer edge formed by a longitudinally extending gauge surface spacedly transversely confronting and of generally the same area as the gauge surface of the aperture and a longitudinally extending field surface spacedly transversely confronting and of generally the same area as the field surface of the aperture, the field surface of the track plate being of substantially greater area than the gauge surface of the aperture; and an elastomeric mass generally filling a space between the gauge surfaces and the field surfaces of the aperture and track plate.

2. The track-mounting assembly defined in claim 1, wherein the field surfaces of the inner and outer edges of the frame and track plate have a surface area at least half again as large as an area of the gauge surfaces of inner and outer edges of the frame and track plate.

3. The track-mounting assembly defined in claim 1, wherein the field surface of the aperture has two sections that are longitudinally and transversely offset from each other and the field surface of the track plate also has two sections that are longitudinally and transversely offset from each other and that each confront a respective one of the sections of the field surface of the aperture.

4. The track-mounting assembly defined in claim 1, wherein the elastomeric mass substantially completely fills the space between the inner edge of the aperture and the outer edge of the track plate.

5. The track-mounting assembly defined in claim 1, wherein the inner edge of the frame is substantially complementary to the outer edge of the track plate.

6. The track-mounting assembly defined in claim 1, wherein the elastomeric mass forms a jacket covering at least some outer surfaces of the track plate and frame.

7. The track-mounting assembly defined in claim 1, wherein the frame has a pair of transversely extending and longitudinally spaced sides longitudinally delimiting the aperture, one of the sides having two straight sections longitudinally offset from each other and each perpendicular to the longitudinal direction, and a center curved section extending generally between the straight end sections, the other of the sides having two straight end sections longitudinally offset from each other and each perpendicular to the longitudinal direction, and a center straight section extending parallel to the longitudinal direction.

* * * * *